US005797170A

United States Patent [19]

Akeno

[11] Patent Number: 5,797,170

[45] Date of Patent: Aug. 25, 1998

[54] SYNTHETIC RESIN MOLDED SURFACE FASTENER

[75] Inventor: Mitsuru Akeno, Toyama-ken, Japan

[73] Assignee: YKK Corporation, Tokyo, Japan

[21] Appl. No.: 807,782

[22] Filed: Feb. 28, 1997

[30] Foreign Application Priority Data

Mar. 4, 1996 [JP] Japan ..... 8-046036

[51] Int. Cl.[6] ..... A44B 18/00

[52] U.S. Cl. ..... 24/452; 24/442; 24/450

[58] Field of Search ..... 24/452, 450, 451, 24/449, 448, 447, 446, 445, 442, 306, 587; 411/508; 63/383

[56] References Cited

U.S. PATENT DOCUMENTS

| | | | |
|---|---|---|---|
| 2,994,117 | 8/1961 | McMullin | 24/587 |
| 3,220,078 | 11/1965 | Preziosi | 411/508 |
| 3,372,442 | 3/1968 | Ishimatsu | 383/63 |
| 3,416,199 | 12/1968 | Imamura | 24/587 |
| 3,808,648 | 5/1974 | Billarant | 24/450 |
| 5,212,853 | 5/1993 | Kaneko | 24/452 |
| 5,361,462 | 11/1994 | Murasaki | 24/452 |
| 5,396,687 | 3/1995 | Osterman . | |

FOREIGN PATENT DOCUMENTS

| | | | |
|---|---|---|---|
| 0 421 295 | 4/1991 | European Pat. Off. . | |
| 1 944 313 | 3/1971 | Germany . | |
| 3908000 | 9/1990 | Germany | 411/508 |
| 94 12238 | 12/1994 | Germany . | |

*Primary Examiner*—Victor N. Sakran
*Attorney, Agent, or Firm*—Hill & Simpson

[57] ABSTRACT

In a synthetic resin molded surface fastener, each of a multiplicity of engaging elements has a stem standing on a front surface of a substrate sheet and a horizontally expandable and shrinkable engaging head continuously formed on and horizontally bulging from an upper end of the stem. The engaging head is divided into two or more segments resiliently bendable toward and away from one another. When the engaging head engages a respective one of engaging heads of a companion surface fastener, each of protuberances projecting from the front surface of the substrate sheet centrally between four adjacent ones of the engaging elements comes into the gap between the segments to bend the segments away from one another, increasing the entire diameter of the engaging head so that the engaging elements can be engaged with those of the companion surface fastener stably without rattling.

13 Claims, 6 Drawing Sheets

SYNTHETIC RESIN MOLDED SURFACE FASTENER

BACKGROUND OF THE INVENTION

1. Field of the Invention

This invention relates to a surface fastener molded of thermoplastic synthetic resin, and more particularly to a molded surface fastener which is suitable for firm engagement with a companion molded surface fastener of the same structure.

2. Description of the Related Art

Surface fasteners molded of synthetic resin to be press-joined have been widely used especially in joining industrial materials and interior ornaments as they are easy to join and have a high degree of joining strength. Generally, the joining members comprise a male molded surface fastener, in which a multiplicity of hook-shape or mushroom-shape engaging elements are molded on and stand from a front surface of a substrate sheet, and a female molded surface fastener, in which a multiplicity of loop-shape engaging elements stand from a front surface of a substrate sheet; engaging surfaces of both the male and female surface fasteners are pressed against each other for engagement. It has been customary that the female surface fastener is in the form of a woven or knit fiber cloth. In the joining members of this combination, the female engaging elements in the form of fiber loops in engagement with the male engaging elements of the molded surface fastener not only tend to be damaged during peeling but also stretch in the rising direction during engagement to leave a space too far between the male and female surface fasteners so that these two surface fasteners cannot be joined together intimately without rattling.

In order to secure a high degree of engaging strength between the male and female engaging elements without either any damage or rattling, male and female synthetic resin molded surface fasteners having substantially the same fitting structure have been disclosed by, for example, Japanese Patent Laid-Open Publications Nos. Sho 47-11770, Sho 52-51242 and Hei 3-286702.

The molded surface fastener disclosed in Japanese Patent Laid-Open Publication No. Sho 47-11770 has a multiplicity of engaging heads each horizontally bulging from the upper end of the individual stem standing on the front surface of a substrate sheet. As the engaging elements coact with the companion engaging elements of the same shape, part of the individual engaging head expands or shrinks horizontally to engage with the companion engaging heads.

The male and female molded surface fasteners disclosed in Japanese Patent Laid-Open Publication No. Sho 52-51242 have the same structure, the male and female engaging elements of which have generally S-curve surfaces extending perpendicularly to the front surface of the substrate sheet, and each of spherical engaging elements has a hollow centrally in its top. As joining members of male and female surface fasteners having the same structure are pressed against each other for engagement, the peripheral portions of the hollow of each engaging element resiliently deforms radially inwardly to facilitate engaging of the engaging elements with those of the companion surface fastener, and they resilitntly restore their original shape upon completion of the engagement, to secure an intimate engagement of the individual engaging element with the engaging elements of the companion surface fastener along each other's S-curve surfaces.

In the molded surface fasteners disclosed in Japanese Patent Laid-Open Publication No. Hei 3-286702, male and female surface fasteners have the same structure, and a multiplicity of engaging elements, each of which has a pair of stems standing on the front surface of the substrate sheet and a hemispheric engaging head bridging the upper end of the stems and having a disc shape with its upper surface bulging arcuately, are arranged in matrix on the front surface of the Substrate sheet, and a multiplicity of stop projections are arranged on the front surface of the substrate sheet each centrally between the engaging elements arranged in the matrix. The height of the stop projections is such that each stop projection comes into contact with the top of the respective engaging head when the engaging elements are engaged with those of the companion surface fastener.

According to the molded surface fasteners disclosed in Japanese Patent Laid-Open Publications Nos. Sho 47-11770 and Sho 52-51242, since part or whole of the individual engaging heads coact with those of the companion surface fastener to resiliently deform radially inwardly when the individual engaging elements are engaged with those of the companion surface fastener, a smooth engagement can be achieved. However, when a peeling force is exerted on the surface fasteners after the engaging elements have been engaged with those of the companion surface fastener, the individual engaging head is easy to resiliently deform radially inwardly so that the surface fastener is easily released from the companion surface fastener.

In the molded surface fastener disclosed in Japanese Patent Laid-Open Publication No. Hei 3-286702, since the engaging head of each engaging element does not deform radially inwardly, the adjacent engaging elements prevent those of the companion surface fastener from entering and, as a result, they are extremely hard to engage. In order to secure smooth engagement, it is inevitable to increase the distance between the engaging elements arranged on the substrate sheet, which results in a reduced degree of engaging strength.

SUMMARY OF THE INVENTION

It is therefore an object of this invention to realize smooth engagement of molded surface fastener made of synthetic resin and having a certain degree of rigidity by pressing them against each other, and also to provide the molded surface fastener with which engaging elements once engaged do not rattle and which has a high degree of engaging strength so as to prevent their disengagement.

According to this invention, the above object is accomplished by a synthetic resin molded surface fastener comprising: a substrate sheet; a multiplicity of engaging elements standing on a front surface of the substrate sheet, each of the engaging elements having a stem rising from the front surface of the substrate sheet and an engaging head continuously formed on and horizontally bulging from an upper end of the stem, the engaging head being expandable and shrinkable horizontally; and a multiplicity of head-diameter enlarging means each for enlarging a diameter of the engaging head when the engaging head engages a respective one of engaging heads of a companion surface fastener.

Preferably, the engaging head is divided into two or more segments by at least one separating plane perpendicular to the substrate sheet surface, the segments being spaced one another by a predetermined gap. In this case, if the separating plane extends into the stem, it is enough to give the engaging head an expanding and shrinking function. Preferably, however, the separating plane extends to the front surface of the substrate sheet. With this structure, it is possible to facilitate resiliently bending the engaging head and the stem and to secure smooth engagement between engaging elements and reliable expansion of the engaging head by the head-diameter enlarging means as well as adequate engaging strength.

For a preferable form, each head-diameter enlarging means is a taper protuberance projecting from the front surface of the substrate sheet at a central position between front and rear and right and left adjacent ones of the engaging elements that are arranged in matrix. According to this form, as the surface fastener is pressed against a companion surface fastener, the engaging head, which coacts with the engaging heads of the front and rear and right and left engaging elements, enters between the engaging elements of the companion surface fastener, shrinking in diameter, and then resiliently restores its original shape and, at the same time, the individual protuberance enters between the segments of each engaging head to resiliently bend the segments further radially outwardly to increase the diameter of the engaging head, thus causing a firm engagement with the expanded engaging heads of the companion surface fastener without rattling and the disengagement can be surely avoided. For releasing the engagement between the engaging elements of the two surface fasteners by a desired peeling force, the whole shape of the individual engaging head may be modified as desired. For example, the shape of the bulging of the engaging head may be changed from a mushroom's umbrella into a mere sphere in accordance with the required engaging strength.

For another preferable form, each head-diameter enlarging means comprises a bridge between tops of the segments of the engaging head, a length between connecting ends of the bridge being larger than the distance between the segments of the engaging head. According to this form, as the surface fastener is pressed against a companion surface fastener, the engaging head, which coacts with the engaging heads of the front and rear and right and left engaging elements enters between the engaging elements of the companion surface fastener, shrinking in diameter, and then resiliently restores its original shape and, at the same time, the arcuate bridge between the segments of each engaging head is pressed against the front surface of the substrate sheet of the companion surface fastener to resiliently deform straight due to the reactive force. With the bridging force involved at this time, the segments are bent resiliently further radially outwardly to increase the diameter of the engaging head, thus causing a firm engagement with the engaging heads of the companion surface fastener similarly, and thereafter, they have no rattling and the disengagement can be surely avoided. For obtaining adequate peeling strength between the engaging elements, the degree of rigidity of the bridge may be modified as by changing the molded thickness.

DETAILED DESCRIPTION OF THE PREFERRED EMBODIMENTS

Figure 1:
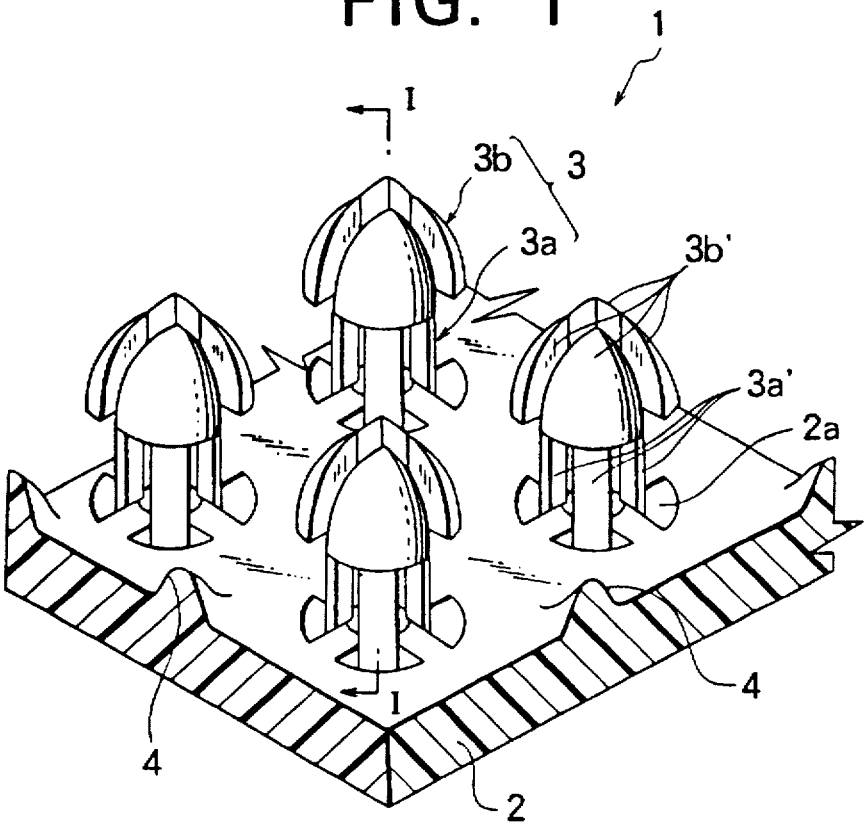
FIG. 1 is a fragmentary perspective view of a molded surface fastener according to a first embodiment of this invention.

Typical embodiments of this invention will now be described in detail with reference to the accompanying drawings. FIG. 1 is a fragmentary perspective view of a molded surface fastener according to a first embodiment, FIG. 2 is a cross-sectional view taken along the line I—I of FIG. 1, and FIG. 3 is a cross-sectional view taken along the line II—II of FIG. 2.

Figure 2:
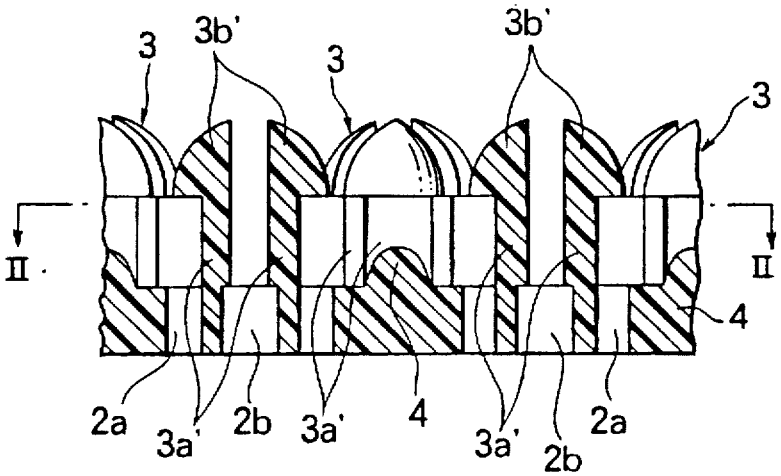
FIG. 2 is a cross-sectional view taken along the line I—I of FIG. 1.
Figure 3:
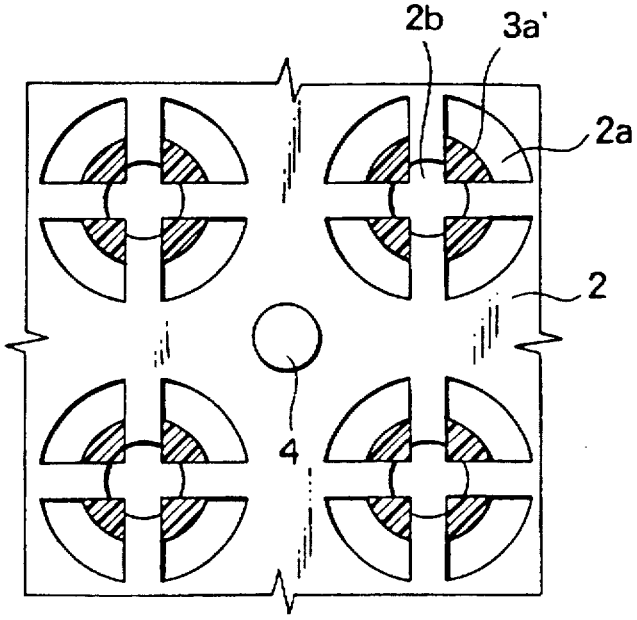
FIG. 3 is a cross-sectional view taken along the line II—II of FIG. 2.

In FIGS. 1 through 3, reference numeral 1 designates a molded surface fastener manufactured by injection molding using thermoplastic synthetic resin material. This thermoplastic synthetic resin material is exemplified by polyamide resin, polyester resin, polypropylene resin, polyvinyl resin, polystyrene resin and polyurethane resin individually and in combination. In order to facilitate molding process, it is preferable that the molded surface fastener 1 of this invention should have a rational shape.

The whole of the molded surface fastener 1 is made of the same kind of synthetic resin material. The molded surface fastener 1 comprises a substrate sheet 2, a multiplicity of engaging elements 3 arranged on a front surface of the substrate sheet 2 in matrix, and a multiplicity of protuberances 4 arranged on the front surface of the substrate sheet 2 in matrix each at a central position between the front and rear and right and left engaging elements 3. Although the height of the protuberances 4 may be determined as desired, it is required to be such that right before an engaging head 3*b* described below of the engaging element engages a mating engaging head 3*b*, a top of each protuberance 4 can project centrally into the individual engaging head 3*b* of a companion surface fastener of the same structure. Each of the engaging elements 3 has a cylindrical stem 3*a* standing on the front surface of the substrate sheet, and the hemispheric engaging head 3*b* horizontally bulging from an upper end of the stem 3*a*.

As is apparent from FIGS. 1 through 3, the engaging element 3 of the first embodiment is composed of subdivided stems 3*a*' which are formed by dividing the cylindrical stem 3*a* as the horizontal cross section is divided into four segments by a predetermined gap of a cross shape, and subdivided heads 3*b*' which are formed by dividing the substantially hemispheric engaging head 3*b*, provided on top of each subdivided stems 3*a*', into four segments. Thus, the the separating surface of the engaging head 3*b* vertically extend to the front surface of the substrate sheet 2 through the stem 3*a*. The arcuate surface of a base of each subdivided stem 3*a*' is surrounded by a fan-shaped hole 2*a* extending radially and through the substrate sheet 2. Further, the substrate sheet 2 has in a rear surface of the substrate sheet 2 a multiplicity of through-holes 2*b* one centrally at the base end of each stem 3*a*, each through-hole 2*b* having a circular cross section slightly larger in diameter than a circle tangent to the inner corners of the four subdivided stems 3*a*'.

Each protuberance 4 projecting from the front surface of the substrate sheet 2 at a central position between the front and rear and right and left engaging elements 3 serves as one example of head-diameter enlarging means that constitutes a part of important elements of this invention. In this illustrated example, the protuberance 4 is in the form of a generally hemisphere molded on the front surface of the substrate sheet 2 simultaneously with the molding of the substrate sheet 2 and the engaging elements 3. Alternatively, the protuberance 4 may be a generally conical shape. Namely, as long as it is taper toward its top, the protuberance 4 can enlarge the diameter of the engaging head 3*b* of the companion surface fastener when it is inserted into the enlarging head 3*b*.

The fan-shape hole 2*a* formed in the substrate sheet 2 and the subdivided head 3*b*' formed on the upper end of each subdivided stem 3*a*' have a common projected plane. Assuming that the boundary plane of the stem 3*a* and the engaging head 3*b* is a parting line P1 as shown in FIG. 2, the fan-shaped holes 2*a* and the central through-hole 2*b* formed centrally of the subdivided stem 3*a*' are required as derivatives depending on the design of an injection molding die, as a molding expert can readily understand.

Figure 4:
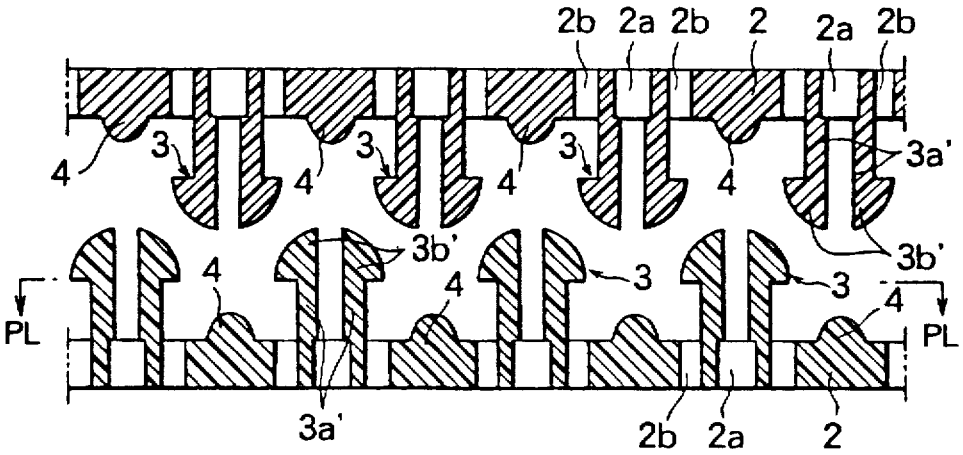
FIG. 4 is a cross-sectional view showing the molded surface fastener of the first embodiment before being pressed against a companion surface fastener of the same structure for engagement.
Figure 5:
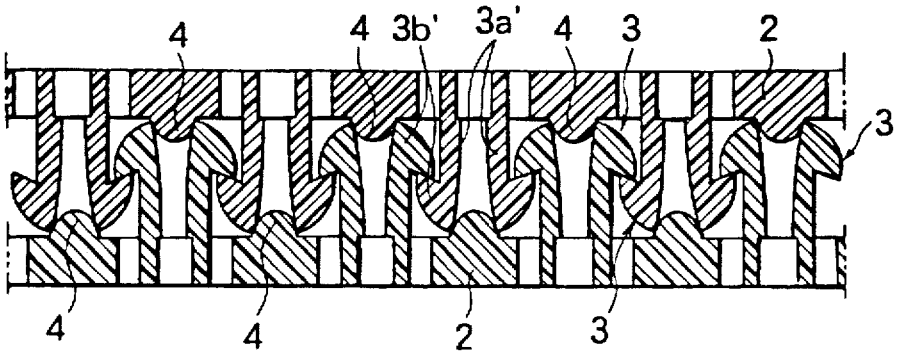
FIG. 5 is a cross-sectional view showing the molded surface fastener when it is engaged with the companion surface fastener by pressure.

The function of the molded surface fastener at the time of press-joining according to the first embodiment of this invention will now be described with reference to FIGS. 4 and 5. FIG. 4 shows two molded surface fastener 1 of the above-described structure before having been pressed against each other, with their engaging elements 3 in confronting relationship. As the two surface fasteners 1 are pressed against each other as being pressed from rear side, the individual engaging elements 3 of one surface fastener 1 enter between those, arranged in matrix, of the other surface fastener 1 while touching their spheric portions of the engaging heads 3*b*. At that time, as the engaging elements 3 of one surface fastener 1 are forced between the engaging elements 3 of the other surface fastener 1 while touching the engaging heads 3*b* each other, the four subdivided stems 3*a*' of each engaging element 3 on one surface fastener 1 are bent inwardly under each other's pressure of the subdivided heads 3*b*' to reduce the entire diameter of the engaging head 3*b* so that the engaging heads 3*b* of one surface fastener 1 can enter between those of the other surface fastener 1 smoothly.

Immediately before the engaging heads 3*b* of each surface fastener 1 go over the engaging heads 3*b* of the other surface fastener 1, each protuberance 4 projecting from the substrate sheet 2 of the companion surface fastener is inserted centrally into the four subdivided heads 3*b*', which are gathered. With continued insertion of the engaging heads 3*b* to go over those of the companion surface fastener, each protuberance 4 advances further to resilitntly push the four subdivided heads 3*b*' away from one another to the maximum due to the slope of the protuberance 4 so that the engaging heads 3*b* can be engaged with those of the companion surface fastener firmly without rattling as shown in FIG. 5. As a result, it is impossible to separate the firmly joined surface fasteners 1 with a limited peeling force.

The shape of the engaging heads 3*b* may be modified in order to adjust the peeling force. For example, in order to enable disengagment with a limited peeling force, the lower surface of the engaging head 3*b* may be convex rather than horizontal and flat, bulging downwardly. As the curvature of the arcuate surface is varied, the peeling force can be adjusted.

Figure 6:
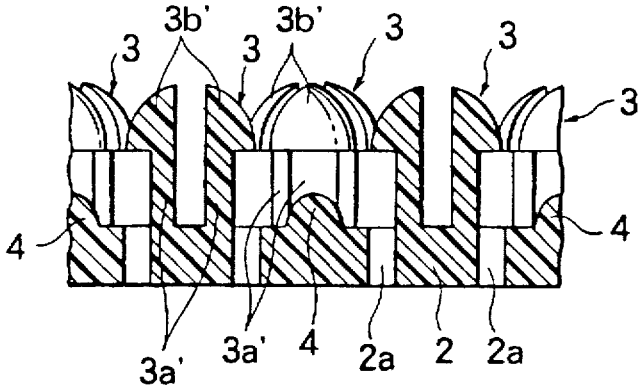
FIG. 6 is a vertical cross-sectional view corresponding to FIG. 2 showing a modification of the first embodiment.
Figure 7:
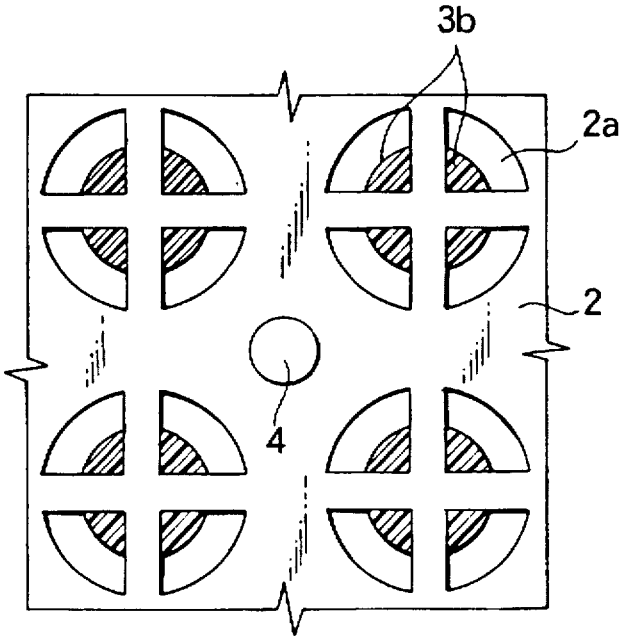
FIG. 7 is a horizontal cross-sectional view of FIG. 6, coresponding to FIG. 3.
Figure 8:
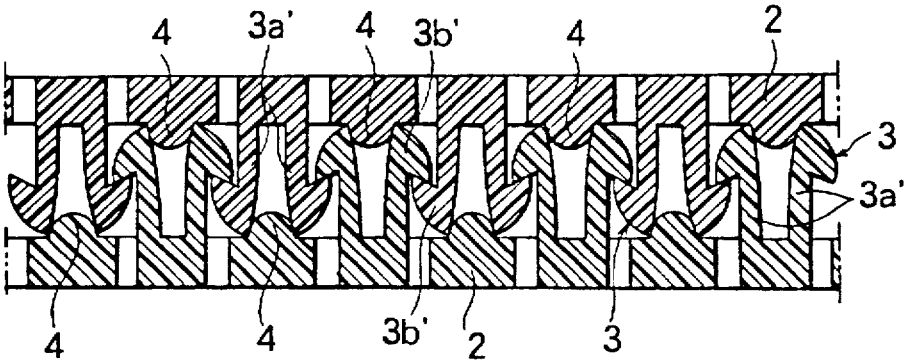
FIG. 8 is a cross-sectional view showing the molded surface fastener of the modification of FIG. 6 when it is engaged with a companion surface fastener of the same structure by pressure.

FIGS. 6 through 8 show a modification of the first embodiment. In this modification, the molded surface fastener 1 is substantially identical in construction with the first embodiment except that the through-hole 2*b* of the substrate sheet 2 on the lower side of the base of the stem 3*a* are omitted. Even without the through-holes 2*b*, it is possible to accomplish the object of this invention adequately and to facilitate designing the molding die and performing the molding process, thus reducing the cost of projection.

Figure 9:
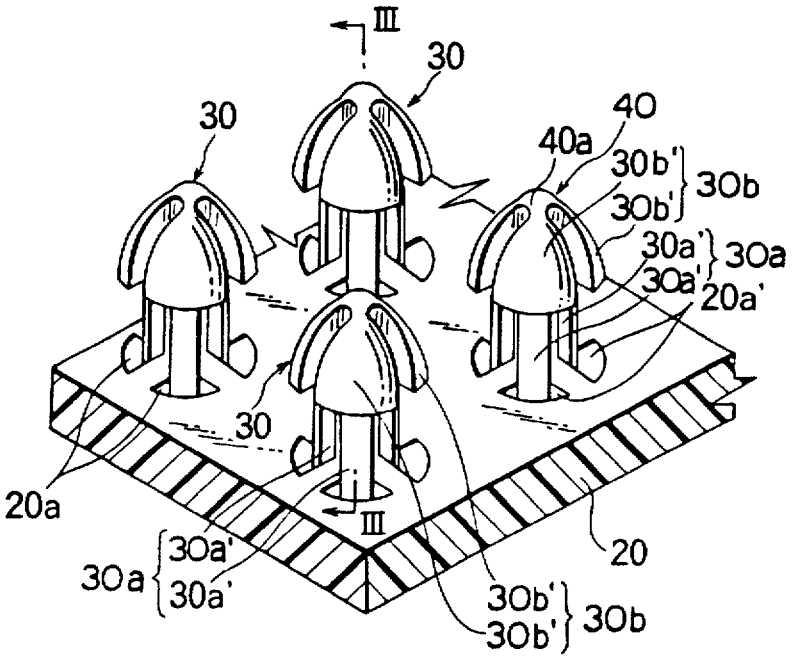
FIG. 9 is a fragmentary perspective view of a molded surface fastener according to a second embodiment of this invention.
Figure 10:
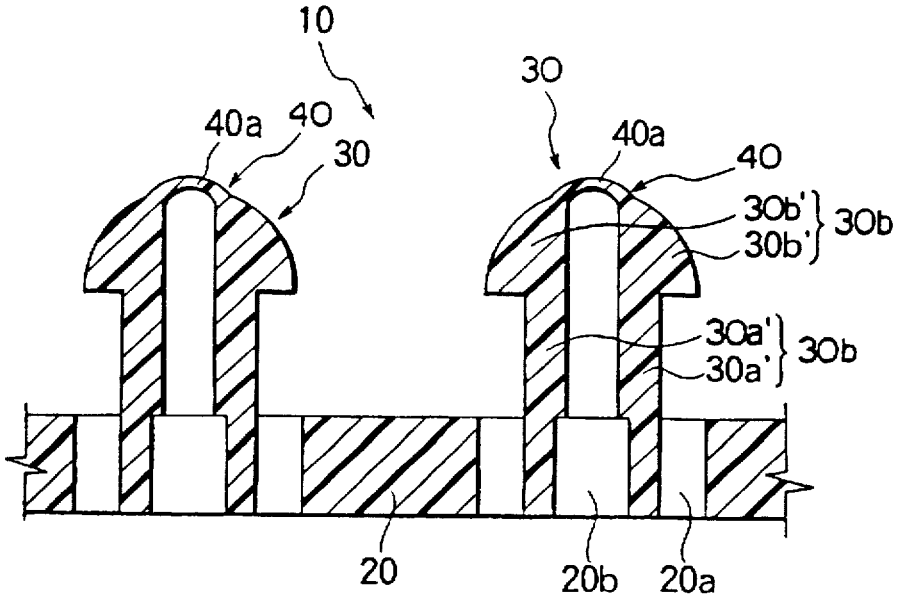
FIG. 10 is a cross-sectional view taken along the line III—III of FIG. 9.
Figure 11:
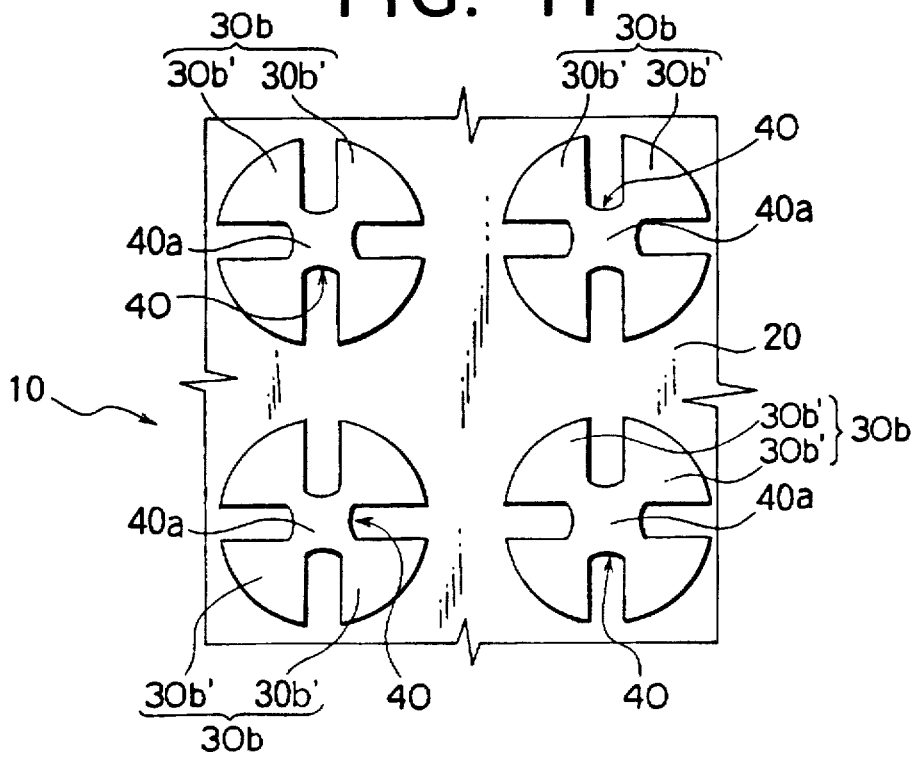
FIG. 11 is a plan view of the molded surface fastener of the second embodiment of FIG. 10.
Figure 12:
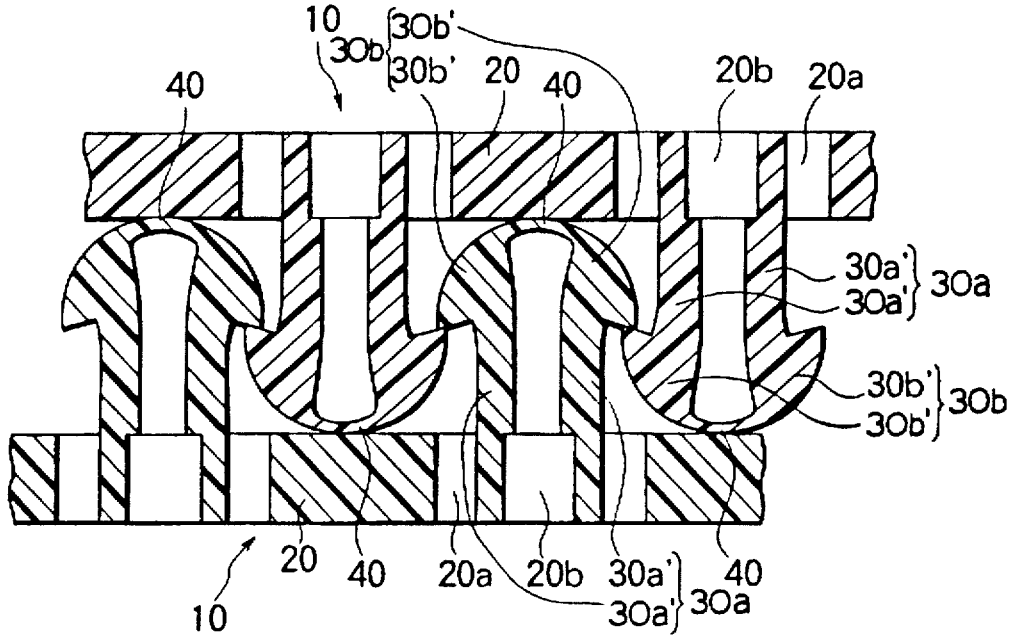
FIG. 12 is a cross-sectional view of the molded surface fastener of the second embodiment when it is engaged with a companion surface fastener of the same structure by pressure.

FIGS. 9 through 11 show a molded surface fastener according to a second embodiment of this invention. FIG. 9 is a fragmentary perspective view of the molded surface fastener of the second embodiment, FIG. 10 is a cross-sectional view taken along the line III—III of FIG. 9, and FIG. 11 is a fragmentary plan view of the molded surface fastener of the second embodiment. And FIG. 12 is a cross-sectional view showing the molded surface fastener of the second embodiment having been engaged with a companion surface fastener of the same structure.

This embodiment is differentiated in structure from the first embodiment by the head-diameter enlarging means of the engaging head, leaving the remaining structure substantially similar to that of the first embodiment of FIGS. 1 through 3. Accordingly, parts or elements similar to those of the first embodiment are designated by like reference numerals, and their detailed description is omitted here and the description concentrates on the head-diameter enlarging means.

A molded surface fastener 10 according to this embodiment comprises a substrate sheet 20 integrally molded of synthetic resin material by injection, and a multiplicity of engaging elements 30 each having a stem 30*a* and an engaging head 30*b* and arranged in the front surface of the substrate sheet 20 in matrix. In this embodiment, like the first embodiment, each engaging element 30 is composed of a set of four subdivided stems 30*a*' standing upright, four subdivided heads 30*b*' each having a quarter-hemispheric form radially bulging from the upper end of each subdivided stem 30*a*', and a bridge 40 extending between tops of the subdivided heads 30*b*'. The subdivided stems 30*a*' and the subdivided heads 30*b*' are substantially identical in structure with those of the first embodiment.

This bridge 40 is a typical example of the head-diameter enlarging means that constitutes a part of important elements of this invention. In this embodiment, as is understood from FIGS. 10 and 11, the bridge 40 is in the form of a generally square plate, four corners of which are integrally molded to be connected with the respective upper ends of the four subdivided heads 30*b*'. However, if the bridge 40 were in the form of a generally square flat plate connecting the tops of the subdivided heads 30*b*', the engaging head 30*b* could not have been enlarged in diameter. Consequently, in this embodiment, the four side edges of the bridge 40 are inwardly curved, and the center of the bridge 40 is convex upwardly.

When a bulged central portion 40*a* of the bridge 40 is pressed from the upper side to resiliently deform, it must have function to cause the four subdivided stems 30*a*' to bend radially outwardly by spreading force toward four corners so that the four subdivided heads 30b' are moved away from one another. For this purpose, the bridge 40 requires an adequate degree of rigidity, if a specified material is given, it is possible to obtain such rigidity by adjusting the thickness of the bridge 40. In the illustrated example, the bridge 40 has uniform thickness over its entire area. Alternatively, the thickness of the bridge 40 may be varied locally or may has a simple cross shape. Although the bulging amount of the bulged central portion 40a of the bridge 40 can be set as desired, it is preferable that the height of the subdivided stem 30a' is set smaller than the total height of the engaging head 30b including the bulging amount of the bulged central portion 40a of the bridge 40 in order that the engaging elements 30 are engaged with those of the companion surface fastener firmly without rattling.

The manner in which the molded surface fastener of the second embodiment is engaged with the companion surface fastener of the same structure will now be described using FIG. 12.

FIG. 12 shows the engaging elements 30 in engagement when two molded surface fastener 10 of the second embodiment have been pressed to engage. As the two surface fasteners 10 are pressed against each other from their rear sides, with their engaging surface facing each other, the individual engaging elements 30 of one surface fastener 10 enter between those, arranged in matrix, of the other surface fastener 10 while touching their arcuate surfaces of the engaging heads 30b. At that time, as the engaging elements 30 of one surface fastener 10 are forced between the engaging elements 30 of the other surface fastener 10 while touching the engaging heads 30b each other, the four subdivided stems 30a' of each engaging element 30 on one surface fastener 10 are bent inwardly under each other's pressure of the subdivided heads 30b', and the bridge 40 also is bent to reduce the entire diameter of the engaging head 30b. As a result, the engaging heads 30b can enter between those of the other surface fastener 10 smoothly.

With continued insertion of the engaging heads 30b between the engaging elements 30 to go over those of the companion surface fastener, the subdivided heads 30b' resiliently restore away from each other so as to restore their original shape, and simultaneously each bridge 40 is pressed downwardly at the bulged central portion 40a by the front surface of the substrate sheet 20 of the companion surface fastener 10 to resiliently deform the bulged central portion 40a to spread flat, and to push the four subdivided heads 30b' away from one another by the reactive force, and further the engaging heads 30b can be engaged with those of the companion surface fastener firmly without rattling as shown in FIG. 12. As a result, it is impossible to separate the joined surface fasteners 10 with a limited peeling force.

In order to adjust the peeling force, the shape of the engaging heads 30b may be modified likewise the first embodiment, or the thickness of the bridge 40 between the subdivided heads 30b' may be set to be thin. If the same material is given, the smaller the thickness of the bridge 40, the more the bridge 40 will become flexible. As a result, the two molded surface fasteners 10 can be separated relatively easily by the required peeling force.

This invention should by no means be limited to the illustrated typical examples, and various other modifications may be suggested.

As is apparent from the foregoing description, according to the molded surface fastener of this invention, partly since at least the engaging head 3b, 30b of each engaging element 3, 30 is expandable and shrinkable in diameter to facilitate engaging the engaging elements 3, 30 with those of the companion surface fastener 1, 10, and partly since the substrate sheet 2, 20 or the individual engaging head 3b, 30b is provided with the head-diameter enlarging means which functions together with the substrate sheet 2, 20 to spread the companion engaging head 3b, 30b in diameter, when the two surface fasteners having generally identical structure are pressed against each other, the engaging heads 3b, 30b are enlarged in diameter by the head-diameter enlarging means and the individual engaging head 3b, 30b is maintained in an expanded posture, thus causing the engaging elements 3, 30 to engage with those of the companion surface fastener firmly without rattling.

What is claimed is:

1. A synthetic resin molded surface fastener comprising:

(a) substrate sheet;

(b) a multiplicity of engaging elements standing on a front surface of said substrate sheet, each of said engaging elements having a stem rising from said front surface of said substrate sheet and an engaging head continuously formed on and horizontally bulging from an upper end of said stem, said engaging head being expandable and shrinkable horizontally; and (c) a multiplicity of head-diameter enlarging means for enlarging diameter of said engaging heads when said engaging heads engage engaging heads of a companion surface fastener, said head-diameter enlarging means enlarging the diameter of said engaging heads from a first diameter when said engaging heads are disengaged from the companion surface fastener to a second diameter which is larger than the first diameter when said engaging heads are engaged with the companion surface fastener.

2. A synthetic resin molded surface fastener according to claim 1, wherein said engaging head is divided into two or more segments by at least one separating plane perpendicular to said surface of said substrate sheet, said segments being spaced one another by a predetermined gap.

3. A synthetic resin molded surface fastener according to claim 2, wherein each said head-diameter enlarging means is a taper protuberance projecting from said front surface of said substrate sheet at a central position between front and rear and right and left adjacent ones of said engaging elements that are arranged in matrix.

4. A synthetic resin molded surface fastener according to claim 2, wherein each said head-diameter enlarging means comprises a bridge between tops of said segments of said engaging head, a length between connecting ends of said bridge being larger than said distance between said segments of said engaging head.

5. A synthetic resin molded surface fastener according to claim 2, wherein said separating plane extends into said stem.

6. A synthetic resin molded surface fastener according to claim 5, wherein each said head-diameter enlarging means is a taper protuberance projecting from said front surface of said substrate sheet at a central position between front and rear and right and left adjacent ones of said engaging elements that are arranged in matrix.

7. A synthetic resin molded surface fastener according to claim 5, wherein each said head-diameter enlarging means comprises a bridge between tops of said segments of said engaging head, a length between connecting ends of said bridge being larger than said distance between said segments of said engaging head.

8. A synthetic resin molded surface fastener according to claim 2, wherein said separating plane extends to said front surface of said substrate sheet.

9. A synthetic resin molded surface fastener according to claim 8, wherein each said head-diameter enlarging means is a taper protuberance projecting from said front surface of said substrate sheet at a central position between front and rear and right and left adjacent ones of said engaging elements that are arranged in matrix.

10. A synthetic resin molded surface fastener according to claim 8, wherein each said head-diameter enlarging means comprises a bridge between tops of said segments of said engaging head, a length between connecting ends of said bridge being larger than said distance between said segments of said engaging head.

11. A synthetic resin molded surface fastener according to claim 1, wherein each said head-diameter enlarging means is a taper protuberance projecting from said front surface of said substrate sheet at a central position between front and rear and right and left adjacent ones of said engaging elements that are arranged in matrix.

12. A synthetic resin molded surface fastener according to claim 1, wherein each said head-diameter enlarging means comprises a bridge between tops of said segments of said engaging head, a length between connecting ends of said bridge being larger than said distance between said segments of said engaging head.

13. A synthetic resin molded surface fastener according to claim 1, wherein the molded surface fastener is engageable with a companion molded surface fastener of the same structure.

* * * * *